US005769419A

United States Patent [19]

Hill

[11] Patent Number: 5,769,419

[45] Date of Patent: Jun. 23, 1998

[54] FOOTBALL BOARD GAME

[76] Inventor: Tomas Hill, 461 W. 9th St., #304, Mesa, Ariz. 85201

[21] Appl. No.: 914,564

[22] Filed: Aug. 19, 1997

Related U.S. Application Data

[60] Provisional application No. 60/027,991, Oct. 9, 1996.

[51] Int. Cl.[6] ..... A63F 3/00

[52] U.S. Cl. ..... 273/247

[58] Field of Search ..... 273/242, 243, 273/244, 247, 277

[56] References Cited

U.S. PATENT DOCUMENTS

| | | | |
|---|---|---|---|
| 1,537,648 | 5/1925 | McCamen . | |
| 1,563,680 | 12/1925 | Zwirner | 273/247 |
| 3,043,594 | 7/1962 | Seitz | 273/94 |
| 3,103,361 | 9/1963 | Board | 273/247 |
| 4,003,580 | 1/1977 | Haffey, Jr. | 273/134 CF |
| 4,169,600 | 10/1979 | Rakowski | 273/247 |
| 4,173,346 | 11/1979 | Godwin | 273/247 |
| 4,524,975 | 6/1985 | Caughie et al. | 273/247 |
| 4,706,959 | 11/1987 | Price | 273/247 |
| 4,773,650 | 9/1988 | Doughty | 273/247 |
| 4,989,879 | 2/1991 | Nigh | 273/247 |
| 5,040,796 | 8/1991 | Schall | 273/247 X |
| 5,217,229 | 6/1993 | Jaime | 273/247 |
| 5,405,141 | 4/1995 | Wilkes | 273/247 |
| 5,451,050 | 9/1995 | Charles | 273/94 |
| 5,496,036 | 3/1996 | Chester | 273/247 |

*Primary Examiner*—William E. Stoll
*Attorney, Agent, or Firm*—Joseph N. Breaux

[57] ABSTRACT

A football board game including a playing field board having the outline of a football field formed on a substantially flat surface thereof; a ball marker; six decks of playing cards; thirty dice; an outcome chart; two card placement mats each having six card placement areas defined thereon; six penalty chips; and a dice board having two dice throwing areas defined thereon. In a preferred embodiment the football game further includes a number of stat sheets each having areas defined thereon for recording statistics pertinent to the game being played. Each stat sheet preferably Includes areas thereon for recording information regarding rush attempts, rushing yards, passing yards, pass attempts, first downs, passing statistics, and total yards.

18 Claims, 4 Drawing Sheets

FIG. 7

OUTCOME CHART : 1

F=FUMBLE
NG=NO GAIN

17

42

44

46

| | 2 | 3 | 4 | 5 | 6 | 7 | 8 | 9 | 10 | J | Q | K |
|---|---|---|---|---|---|---|---|---|---|---|---|---|
| 2 | F | NG | −1 | −1 | −2 | −2 | −3 | −3 | −4 | +4 | +5 | +5 |
| 3 | +1 | F | NG | −1 | −1 | −2 | −2 | −3 | −3 | +4 | +4 | +5 |
| 4 | +2 | +1 | F | NG | −1 | −1 | −2 | −2 | −3 | +3 | +4 | +4 |
| 5 | +3 | +2 | +1 | F | NG | −1 | −1 | −2 | −2 | +3 | +3 | +4 |
| 6 | +4 | +3 | +2 | +1 | F | NG | −1 | −1 | −2 | +2 | +3 | +3 |
| 7 | +5 | +4 | +3 | +2 | +1 | F | NG | −1 | −1 | +2 | +2 | +3 |
| 8 | +6 | +5 | +4 | +3 | +2 | +1 | F | NG | −1 | +1 | +2 | +2 |
| 9 | +7 | +6 | +5 | +4 | +3 | +2 | +1 | F | NG | +1 | +1 | +2 |
| 10 | +8 | +7 | +6 | +5 | +4 | +3 | +2 | +1 | F | NG | +1 | +1 |
| J | +4 | +4 | +3 | +3 | +2 | +2 | +1 | +1 | + | F | NG | +1 |
| Q | +5 | +4 | +4 | +3 | +3 | +2 | +2 | +1 | +1 | NG | F | NG |
| K | +5 | +5 | +4 | +4 | +3 | +3 | +2 | +2 | +1 | NG | NG | F |

FIG. 8

OUTCOME CHART : 2

F=FUMBLE

19

48

47

50

| | 2 | 3 | 4 | 5 | 6 | 7 | 8 | 9 | 10 | J | Q | K |
|---|---|---|---|---|---|---|---|---|---|---|---|---|
| A/2 | F | +6 | +6 | +5 | +5 | +4 | +4 | +3 | +3 | +2 | +2 | +1 |
| A/3 | +7 | F | +6 | +6 | +5 | +5 | +4 | +4 | +3 | +3 | +2 | +2 |
| A/4 | +8 | +7 | F | +6 | +6 | +5 | +5 | +4 | +4 | +3 | +3 | +2 |
| A/5 | +8 | +8 | +7 | F | +6 | +6 | +5 | +5 | +4 | +4 | +3 | +3 |
| A/6 | +9 | +8 | +8 | +7 | F | +6 | +6 | +5 | +5 | +4 | +4 | +3 |
| A/7 | +9 | +9 | +8 | +8 | +7 | F | +6 | +6 | +5 | +5 | +4 | +4 |
| A/8 | +10 | +9 | +9 | +8 | +8 | +7 | F | +6 | +6 | +5 | +5 | +4 |
| A/9 | +10 | +10 | +9 | +9 | +8 | +8 | +7 | F | +6 | +6 | +5 | +5 |
| A/10 | +11 | +10 | +10 | +9 | +9 | +8 | +8 | +7 | F | +6 | +6 | +5 |
| A/J | +11 | +11 | +10 | +10 | +9 | +9 | +8 | +8 | +7 | F | +6 | +6 |
| A/Q | +12 | +11 | +11 | +10 | +10 | +9 | +9 | +8 | +8 | +7 | F | +6 |
| A/K | +12 | +12 | +11 | +11 | +10 | +10 | +9 | +9 | +8 | +8 | +7 | F |

FOOTBALL BOARD GAME

TECHNICAL FIELD

This application claims the benefits under 35 U.S.C. 119(e) of earlier filed provisional application Ser. No. 60/027,991, filed Oct. 09, 1996. The present invention relates to board games and more particularly to a board game based on the game of football that includes six decks of cards, thirty dice, and an outcome chart that are used to simulate the playing of a game of football.

BACKGROUND OF INVENTION

Many individuals enjoy board games that require some strategy and some luck. In addition many of those individuals enjoy the game of football. It would be desirable, therefore, to have a board game that simulated the playing of a game of football. It would be further desirable to have such a game that was easily learned by beginners and that advanced players could also enjoy.

SUMMARY OF INVENTION

It is thus an object of the invention to provide a football board game that is easy to learn.

It is a further object of the invention to provide a football board game that is still enjoyable for advanced players.

It is a still further object of the invention to provide a football board game that accomplishes both of the above objects in combination.

Accordingly, football board game is provided. The football board game comprises a playing field board having the outline of a football field formed on a substantially flat surface thereof; a ball marker; six decks of playing cards; thirty dice; an outcome chart; two card placement mats each having six card placement areas defined thereon; six penalty chips; and a dice board having two dice throwing areas defined thereon. In a preferred embodiment the football game further includes a number of stat sheets each having areas defined thereon for recording statistics pertinent to the game being played. Each stat sheet preferably includes areas thereon for recording information regarding rush attempts, rushing yards, passing yards, pass attempts, first downs, passing statistics, and total yards.

BRIEF DESCRIPTION OF DRAWINGS

For a further understanding of the nature and objects of the present invention, reference should be had to the following detailed description, taken in conjunction with the accompanying drawings, in which like elements are given the same or analogous reference numbers and wherein:

FIG. 7 is a first exemplary outcome chart that lists the outcomes when the offense and defense each draw a respective offense/defense card between 2 and King during a running play.

FIG. 8 is a second exemplary outcome chart that lists the outcomes when either the offense or the defense draws an Ace and the other player draws between 2 and King during a running play.

EXEMPLARY EMBODIMENTS

Figure 1:
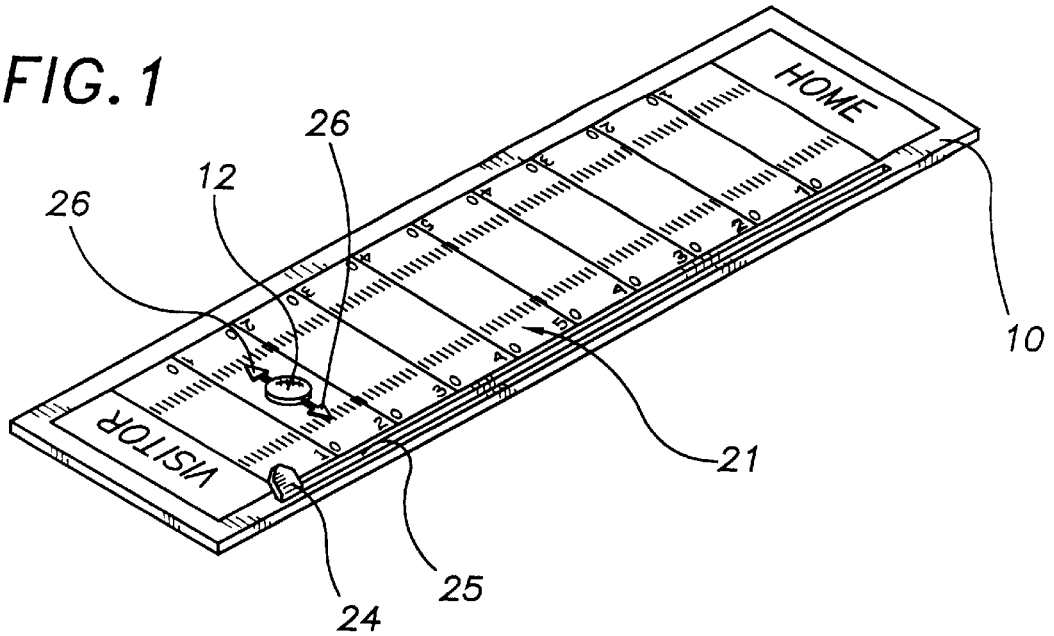
FIG. 1 is a perspective view of an exemplary embodiment of the playing field board of the football board game of the present invention.

The exemplary football board game, described herein below with reference to FIGS. 1–8, includes a playing field board 10 (FIG. 1); a ball marker 12 (FIG. 1); two card placement mats 14 (FIG. 2); six decks of playing cards 16 (FIG. 3);i two erasable stat sheets 18 (FIG. 4); a dice board 20 (FIG. 5); thirty dice 22 (FIG. 6); six penalty chips 15 (FIG. 6A); a first outcome chart 17 (FIG. 7); and a second outcome chart 19 (FIG. 8).

FIG. 1 shows playing field board 10 and ball marker 12. In this exemplary embodiment, playing field board 10 is constructed of a section of pressed fiberboard having the markings of a conventional football playing field, generally indicated 21, printed on a substantially planar side surface thereof. A sliding first-down marker 24 is provided along one side edge of playing field board 10 that is slidable along a trackway 25 positioned adjacent and parallel to the sideline of the playing field. The first-down marker is used to indicate the yardage point where the offensive team achieves a first-down. Ball marker 12 is constructed from plastic and includes a pair of pointers 26 that are aligned along the same axis and used to indicate the scrimmage line when placed on the playing field.

Figure 2:
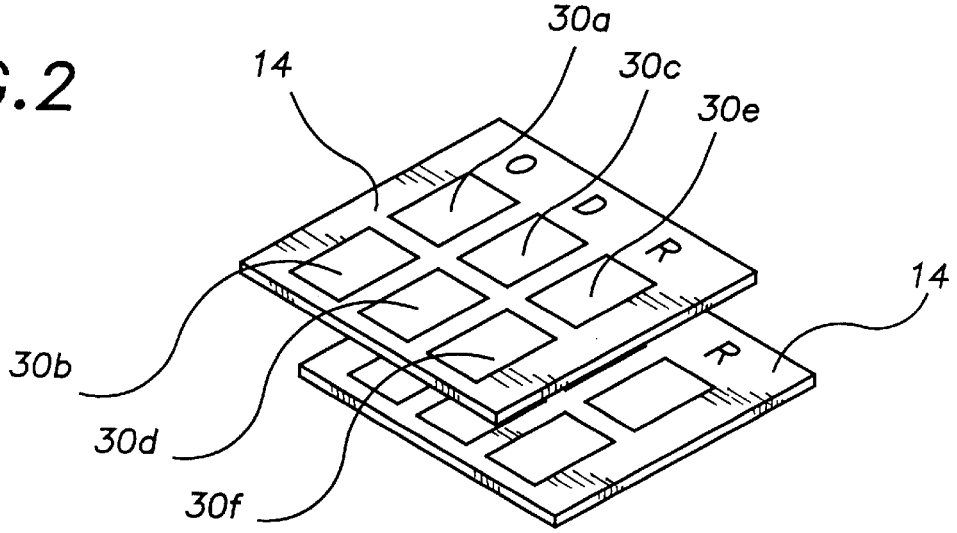
FIG. 2 is a perspective view of two identical exemplary embodiments of the card placement mats.

FIG. 2 shows the two identical exemplary card placement mats 14. Tn this embodiment, each card placement mat 14 is constructed from pressed fiberboard and includes printing on one side thereof that defines six substantially rectangular card positioning areas 30*a–f*. Each card positioning are 30*a–f* is sized to receive one or more stacked playing cards therein. Card positioning areas 30*a –f* are arranged in two rows of three (30*a–c* and 30*d–f*). The letter "O", for offense, is placed above card positioning area 30*a*. The letter "D", for defense, is placed above card positioning area 30*c*. The letter "R", for run, is placed above card positioning area 30*e*.

Figure 3:
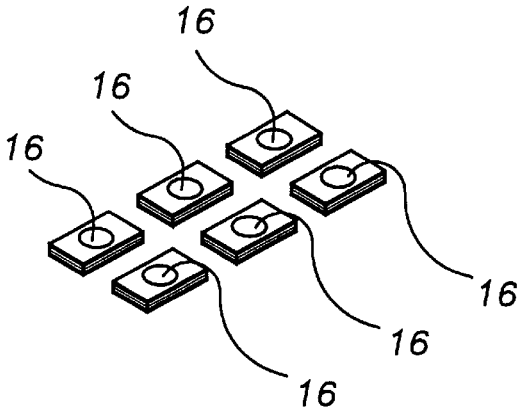
FIG. 3 is a perspective view of six identical embodiments of the six decks of playing cards, each deck containing four sets of thirteen cards conventionally marked two-ace.

FIG. 3 shows the six identical decks of playing cards 16. Although this embodiment uses conventional decks of poker playing cards having four suits with thirteen cards 2-ace in each suit, decks of cards having four sets containing the numerals 2–14 can also be used.

In use, each player receives a card placement mat 14 and three decks of cards 16—an "offense" deck, a "defense" deck, and a "run" deck. Each of the decks is shuffled and the "offense" deck placed in card holding area 30*a*, the "defense" deck placed in card holding area 30*c*, and the "run" deck placed in card holding area 30*e*. Card holding areas 30*b*,30*d*,30*f* are used for discarded cards from the decks in card holding areas 30*a*,30*c*,30*e* respectively. During play, all cards from card holding areas 30*a*,30*c*,30*e* must be discarded face up in its respective card holding area 30*b*,30*d*,30*f*.

Figure 4:
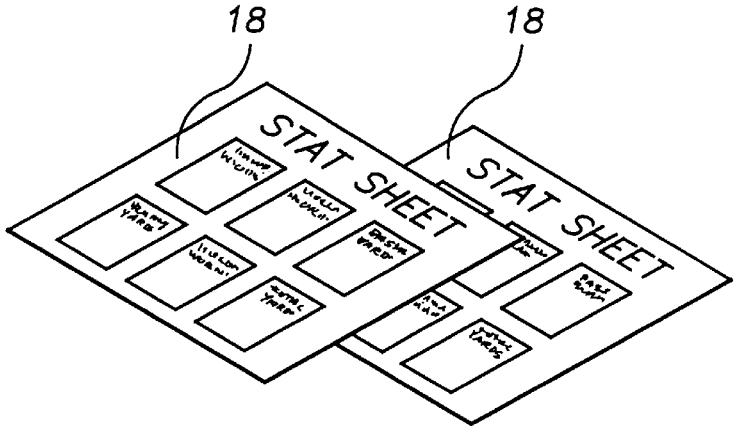
FIG. 4 is a perspective view of two identical exemplary stat sheets of the football board game of the present invention.

FIG. 4 shows the two identical erasable stat sheets 18. Each stat sheet 18 is constructed from pressed fiberboard with an erasable coating provided on one side surface thereof. The erasable coating has five boxes defined thereon labeled to provide areas for recording statistics related to the players team performance. Although in this exemplary embodiment the five boxes are dedicated to recording statistics related to rush attempts, rushing yards, passing yards, pass attempts, first downs, passing statistics, and total yards; any other statistics desired to be recorded can be recorded in the Five areas.

Figure 5:
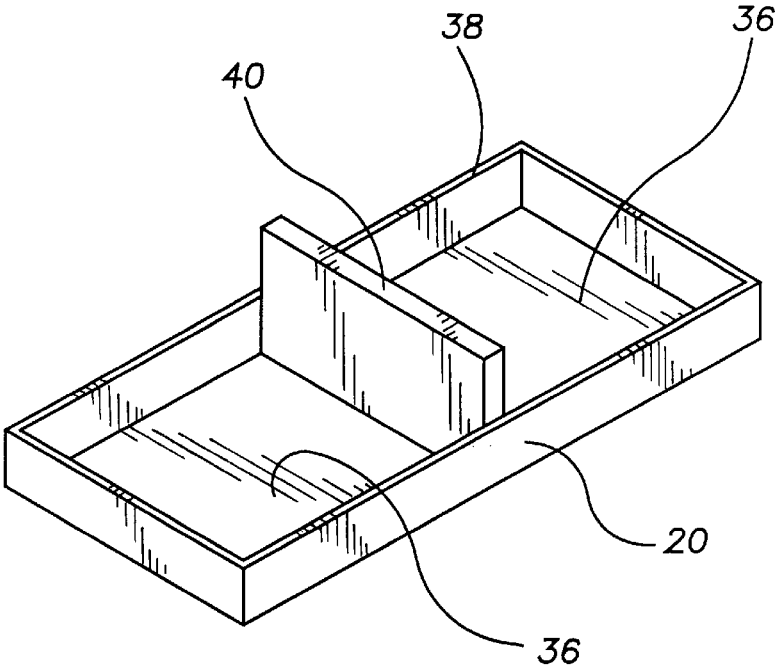
FIG. 5 is a perspective view of an exemplary embodiment of the dice board showing the first and second dice rolling areas.

FIG. 5 shows an exemplary embodiment of dice board 20. Dice board 20 is constructed from pressed fiberboard and includes two dice throwing areas 34,36 that are defined by a raised perimeter sidewall 38 and a central dividing wall 40. FIG. 6 shows the thirty dice 22. Dice 22 are conventional six-sided die with the numerals one-six indicated on the six faces thereof. Dice 22 and dice board 20 are used to determine if the ball changes hands during a fumble or an interception, and in kickoffs, punts, field goals, and extra point plays. The specific mode of their use in these plays will be described hereinbelow in detail.

Figure 6A:
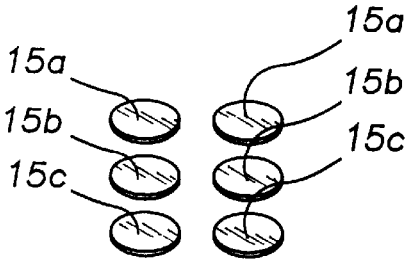
FIG. 6A is a perspective view of the six penalty chips.
Figure 6:
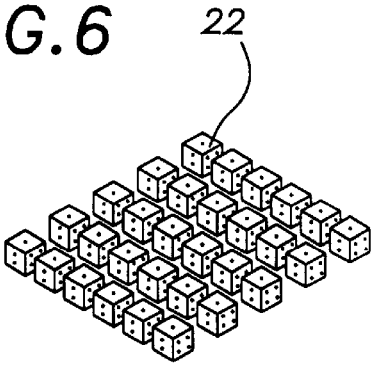
FIG. 6 is a perspective view of thirty identical exemplary dice.

FIG. 6A shows the six penalty chips 15*a*,15*b*,15*c*. Two penalty chips 15*a* are white, two penalty chips 15*b* are blue and two penalty chips 15*c* are red. In use, each player receives one white penalty chip 15*a*, one blue penalty chip 15*b*, and one red penalty chip 15*c*. White penalty chips 15*a* represent a five yard penalty, red penalty chips 15*c* represent a ten yard penalty, and blue penalty chips 5*b* represent a fifteen yard penalty. Use of penalty chips 15*a*,15*b*,15*c* will be discussed in more detail herein below.

FIG. 7 shows the first exemplary outcome chart 17. First outcome chart 17 lists in a grid format the outcomes when the offense and defense each draw a respective offense/defense card between 2 and King from one of the playing card decks 16 when a running play is attempted. The top horizontal row 42 shows the defensive teams card. The leftmost vertical row 44 shows the offensive teams card. The outcome of a particular down is determined by finding the cell within the grid that lies at the intersection of a vertical line drawn from the defensive card and the horizontal line draw from the offensive card. For example: if the offensive card is a "J" (Jack), and the defensive card is a "six" (6), the cell corresponding to the intersection, cell 46, indicates the outcome should be an offensive gain of two yards. As indicated by first outcome chart 17, the offense can gain yardage, lose yardage, have no gain of yardage, and fumble the ball. First outcome chart 17 is only used when no player draws an "Ace". If an "ace" is drawn by either player then second outcome chart 19 is used.

FIG. 8 shows the second exemplary outcome chart 19. Second outcome chart 19 lists in grid format the outcomes when either the offense or the defense draws an Ace and the other player draws between 2 and King from one of the playing card decks 16 when a running play is attempted. During play, the player who draws the "Ace" then draws a second card from the deck to determine which cell in the leftmost column 47 indicates his draw. The player not drawing an "Ace" utilizes the topmost horizontal row 48 to determine the cell indicated by his draw. Regardless of who has the "Ace", the outcome goes to the offense. The outcome of a particular down is determined by finding the cell within the grid that lies at the intersection of a vertical line drawn from the player without the "ace" and the horizontal line draw from the player with the "ace". For example: if the offense draws a "seven" (7) and the defense draws an "Ace" (A), the defense is then required to draw a second card (this second card is hereinafter referred to a an extension card). In this example the defense's second card is a "five" (5). The cell corresponding to the intersection of those lines, cell 50, indicates the a six yard gain for the offense.

Rules of Play:

The rules of play for the exemplary football board game are now described with general reference to FIGS. 1–8.

Defensive and Turnovers:

The defensive deck is in the middle of the card board. When a player is on defense, this is the only deck that is playable. If the offense elects to run, the defense must turn one card over. If the card duplicates the offensive card, a fumble is at risk. A chance to recover the fumble ensues.

The offensive player rolls two dice while the defensive player rolls one. If a match occurs with either dice the offense rolled, phase one is complete. The offense leaves the two dice as is. The first roll, although played against twice is the only roll by the offense. If the defense once again, matches either dice, the fumble is a success for the defense. If either attempt fails, the play stands in the same position.

Scoring:

In this exemplary embodiment points are scored as follows: a touchdown earns six points; an extra point earns one point; a two point conversion earns two points; a safety earns two points, and a field goal earns three points.

Incidental Rules:

The goal line is part of the end zone.

Kicks and punts into the end zone can either be pronounced a touchback and the ball placed at the receiving team's twenty yard line, or run back from the end zone at the option of the receiving team.

A fumble cannot be advanced by either team.

When the offensive team draws "double aces" during a play, the offensive team receives an automatic touchdown.

End of Quarters:

The game consists of four quarters. A quarter ends when either player runs of cards in his/her offensive deck. In the event a player has one offensive card left and desires to pass the ball, that player must shuffle the offensive deck, excluding the remaining card. After the shuffle the top card of that player's offensive deck serves as the extension card. If a player runs out of defensive cards, that player must shuffle the defensive deck and continue playing until a player runs out of offensive cards. All card decks are shuffled before the beginning of the next quarter.

Penalties:

Penalties are assessed against a player when two matching cards are sequentially turned over from the same deck of one of the player's three decks 16. Prior to beginning play, the players stack penalty chips 15*a*–*c* with white penalty chip 15*a* on top, red penalty chip 15*b* in the middle and blue penalty chip 15*c* on the bottom. When a penalty is assessed, the player to receive the penalty is subject to a yardage penalty equal to the value of the penalty chip 15*a*,15*b*,15*c* at the top of the stack. The opponent has the option to refuse the penalty and accept the outcome of the down. Regardless of whether the opponent accepts or rejects the penalty, the top penalty chip 15*a*–*c* is placed at the bottom of the stack. If the opponent accepts the penalty, the ball is moved back the required distance and the down replayed. If both players receive penalties during the same down, the down is replayed and no penalty chips 15*a*–*c* are moved from the top of the stack to the bottom. When a yardage penalty greater than the distance to the goal line is assessed, the player is assessed a yardage penalty equal to half the distance to the goal line.

Kickoff:

Kickoffs are used to start the first and second halves of the game and after each successful touchdown and field goal. All kick offs are initiated from the kicker's own thirty-five yard line. however, penalty yardage can be assessed to move the point of kick off forward or backward as required. The player kicking off has the option of using from one to fifteen die. The total of all dice thrown equals the length of the kick.

For example: if the total value of the dice thrown equals forty-six. The ball is fielded at the receiver's nineteen yard line [100–(46+35)=19].

Onside Kick:

Onside kicks require two dice rolls. The first dice roll must add up to a kick of at least ten yards. If a kick of at least ten yards is achieved, then a dice roll-off is performed. In the first phase of the dice roll-off the receiver rolls two die and the kicker rolls one die. If the kicker's die does not match either of the receiver's die the receiver gains possession of the ball. If the kicker's die matches one of the receiver's die, then a second dice roll is performed. In this dice roll, the kicker rolls one die and the receiver rolls three die. If the kicker's die matches any of the receiver's die, the kicker gains possession of the ball and the onside kick is successful. Otherwise, the receiver gains possession of the ball. If the onside kick is less than ten yards then a fifteen yard penalty is assessed against the kicking team.

Punting:

In a punting play each player has the option of using up to thirteen die. The total value of the dice rolled equals the length of the punt. The ball is spotted at a point equal to the distance from length of the punt from the point of scrimmage minus fifteen yards.

Returns of Punts and Kickoffs:

The receiving player of a punt or a kick returns the punt or kick by flipping over a card from the "run" deck. No fumble is possible when returning a punt or kick. If the card flipped reveals a number between two and ten, the return is for the number of yards indicated by the card. If the card flipped is a Jack (11), Queen (12) or a King (13), the player receivers that number of yards plus the value of the extension card. Extension cards are turned until a number card between two and ten is flipped. If an Ace (14) is flipped, a second extension card is immediately flipped and the value of the return adjusted.

Running With The Ball From Scrimmage:

The ball is run from the scrimmage line as follows. The offensive player flips the top card of the "offense" deck and the defensive player flips the top card of the "defense" deck. The cards are then compared using one of the outcome charts 17,19 as previously described.

Passing:

Passing plays are accomplished as follows. The offense flips two cards from the "offense" deck and the defense flips two cards from the "defense" deck. If the total of the offensive cards is greater than or equal to the defensive cards the pass has been completed. The difference between the value of the offensive cards and the defensive cards equals the distance past the scrimmage line where the pass is received.

After a successful completion of a pass, the offense can run the ball by turning a card from the run deck 30*c*.

Field Goals:

A field goal is attempted in the following manner. When a player feels he is in range for a field goal, a dice roll-off is initiated. The distance required to make the field goal is equal to the yardage value from the line of scrimmage plus fifteen. Thus, if the line of scrimmage is on the fourteen yard line, the field goal attempt is for twenty nine yards. The rules of the dice roll-off are as follows. The ten value of the distance of the field goal attempt determines the number of times the offense must beat the defense in a series of one on one dice rolls. All ties in a field goal roll-off go to the defense. If the defense beats or matches the offense twice in the roll-off, the attempt is over and the field goal is unsuccessful.

Extra Points and Two Point Conversions:

Extra points are played like field goals with the length of the field goal being eighteen yards. A two point conversion is one running play in which the offense must make three or more yards.

Safeties:

To achieve a safety, the defense must knock the offense to the goal line on a sack or loss by rushing.

Interceptions:

Interceptions can occur during a passing play when the offense and defense turn up matching second cards. The total sum of the "offense" cards compared to the total sum of the "defense" cards determines the distance from the line of scrimmage where the interception takes place. Once the match occurs, the offense must roll two dice and the defense one die. If the defense die does not match either of the offense die, no interception has occurred. If a match is made, then a second roll is required with the offense rolling three die and the defense rolling one die. If the defense die matches any of the offense die, then an interception has occurred and the ball changes hands and can be run back by turning a card from the run deck 3*c*. If the play would have resulted in an incomplete pass or a sack, the interception occurred at the line of scrimmage.

Two Minute Offense:

A two minute offense can be played if desired as follows. Each player is given nine cards from the bottom of the "offense" and "defense" deck, respectively. The two minute offense is then played according to the previously described rules. It can be seen from the preceding description that a football board game has been provided that is easy to learn and that is still enjoyable for advanced players.

It is noted that the embodiment of the football board game described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A football board game comprising:

a playing field board having the markings of a football playing field printed on a substantially planar side surface thereof;

a ball marker having a pair of pointers that are aligned along the same axis and used to indicate a scrimmage line when placed on said markings of said playing field board;

two card placement mats, each card placement mat including printing on one side thereof that defines six substantially rectangular card positioning areas;

six decks of playing cards;

two erasable stat sheets, each said erasable stat sheet having an erasable coating provided on one side surface thereof and five boxes defined thereon labeled to provide areas for recording game statistics;

a dice board having dice throwing areas that are partially defined by a raised perimeter sidewall and a central dividing wall;

thirty dice, each dice having six side faces with a numeral from one-six indicated on each of said six side faces; and a first and second outcome charts, the first outcome chart having lists in a grid format to show the outcomes of a card turnover when a running play is attempted and the offensive and defensive players each have drawn a card having a value between a 2 and a King, the second outcome chart having lists in a grid format to show the outcomes of a card turnover when a passing play is attempted and one of the offensive and defensive players has drawn an Ace and the other player has drawn a card having a value between a 2 and a King.

2. The football board game of claim 1, wherein:

said board game further includes six penalty chips, a first pair of said six penalty chips being of a first penalty value indicating color, a second pair of said six penalty chips being of a second penalty value indicating color, and a third pair of said six penalty chips being of a third penalty value indicating color.

3. The football board game of claim 2, wherein:

said playing field board further including a sliding first-down marker provided along one side edge of said playing field board that is slidable along a trackway positioned adjacent and parallel to a sideline of said markings of a football playing field.

4. The football board game of claim 3 wherein:

said ball marker is of molded plastic construction.

5. The football board game claim 4 wherein:

each of said two erasable stat sheets is constructed from pressed fiberboard.

6. The football board game of claim 5 wherein:

each of said two card placement mats is constructed from a section of pressed fiberboard.

7. The football board game of claim 4 wherein:

each of said two card placement mats is constructed from a section of pressed fiberboard.

8. The football board game of claim 3 wherein:

each of said two erasable stat sheets is constructed from pressed fiberboard.

9. The football board game of claim 3 wherein:

each of said two card placement mats is constructed from a section of pressed fiberboard.

10. The football board game of claim 2 wherein:

said ball marker is of molded plastic construction.

11. The football board game of claim 10 wherein:

each of said two erasable stat sheets is constructed from pressed fiberboard.

12. The football board game of claim 10 wherein:

each of said two card placement mats is constructed from a section of pressed fiberboard.

13. The football board game of claim 2 wherein:

each of said two erasable stat sheets is constructed from pressed fiberboard.

14. The football board game of claim 2 wherein:

each of said two card placement mats is constructed from a section of pressed fiberboard.

15. The football board game of claim 1, wherein:

said playing field board further including a sliding first-down marker provided along one side edge of said playing field board that is slidable along a trackway positioned adjacent and parallel to a sideline of said markings of a football playing field.

16. The football board game of claim 1 wherein:

said ball marker is of molded plastic construction.

17. The football board game of claim 1 wherein:

each of said two erasable stat sheets is constructed from pressed fiberboard.

18. The football board game of claim 1 wherein:

each of said two card placement mats is constructed from a section of pressed fiberboard.

* * * * *